United States Patent [19]

Kumagai et al.

[11] 4,219,001

[45] Aug. 26, 1980

[54] METHOD AND APPARATUS FOR ACCUMULATING FUEL PARTICLES IN A PORTION OF A COMBUSTION CHAMBER

[75] Inventors: Seiichiro Kumagai, Koishikawa; Michio Abe, Kasugai Aichi; Naoyuki Maeda, Inuyama, all of Japan

[73] Assignee: Tokai TRW & Co. Ltd., Japan

[21] Appl. No.: 837,842

[22] Filed: Sep. 29, 1977

[30] Foreign Application Priority Data

Sep. 30, 1976 [JP] Japan ..... 51-117593

[51] Int. Cl.[2] ..... F02P 13/00

[52] U.S. Cl. ..... 123/169 EL; 123/143 B; 123/169 E; 123/169 MG; 313/123; 313/141; 313/143

[58] Field of Search ..... 123/119 E, 143 R, 143 B, 123/169 R, 169 EL, 169 E, 169 MG, 169 G; 313/123, 124, 130, 141, 142, 143

[56] References Cited

U.S. PATENT DOCUMENTS

| | | | |
|---|---|---|---|
| 1,506,823 | 9/1924 | Francoeur | 313/123 |
| 1,576,176 | 3/1926 | Corey | 313/123 |
| 2,071,254 | 2/1937 | Cramer | 123/169 |
| 3,318,293 | 5/1967 | Hickling et al. | 123/119 E |
| 3,488,556 | 1/1970 | Burley | 315/60 |
| 3,567,987 | 3/1971 | Schnurmacher | 313/123 |
| 3,577,170 | 5/1971 | Nylen | 313/123 |
| 3,841,824 | 10/1974 | Bethel | 123/119 E |
| 3,842,818 | 10/1974 | Cowell et al. | 123/169 R |
| 3,842,819 | 10/1974 | Atkins et al. | 123/169 R |
| 3,974,412 | 8/1976 | Pratt, Jr. | 123/169 MG |
| 4,020,388 | 4/1977 | Pratt, Jr. | 123/169 MG |
| 4,041,922 | 8/1977 | Abe et al. | 123/143 B |
| 4,051,826 | 10/1977 | Richards | 123/143 B |
| 4,071,800 | 1/1978 | Atkins | 313/123 |
| 4,087,719 | 5/1978 | Pratt, Jr. | 123/169 MG |
| 4,124,003 | 11/1978 | Abe et al. | 123/119 E |

FOREIGN PATENT DOCUMENTS

| | | | |
|---|---|---|---|
| 466694 | 6/1937 | United Kingdom | 123/143 R |

*Primary Examiner*—Charles J. Myhre
*Assistant Examiner*—Andrew M. Dolinar

[57] ABSTRACT

An improved method and apparatus for effecting the ignition of a relatively lean air-fuel mixture includes a pair of electrode gaps at which strong electrostatic fields of relatively long duration are established to accumulate fuel particles in a portion of a combustion chamber adjacent to a spark gap. In one embodiment of the invention, one of the electrode gaps is enclosed so that the atmosphere in this gap is not affected by changes in the pressure and composition of the atmosphere in the combustion chamber. By maintaining the atmosphere in the electrode gap separate from the atmosphere in the combustion chamber, an electrostatic field of substantially constant strength can be maintained at the enclosed electrode gap after the establishment of a corona discharge at an electrode gap exposed to the atmosphere in the combustion chamber. In another embodiment of the invention, both of the electrode gaps are exposed to the atmosphere in the combustion chamber. This embodiment of the invention enables strong electrostatic fields and corona discharges of relatively long duration to be established by providing a secondary or floating electrode which is electrically insulated from both a main electrode surface and a third or tertiary electrode surface.

32 Claims, 10 Drawing Figures

METHOD AND APPARATUS FOR ACCUMULATING FUEL PARTICLES IN A PORTION OF A COMBUSTION CHAMBER

BACKGROUND OF THE INVENTION

This invention relates generally to a new and improved apparatus and method for accumulating fuel particles in a portion of a combustion chamber through the use of a plurality of electrostatic fields.

A method and apparatus utilizing electrostatic fields and corona discharges to attract fuel particles to a portion of an engine combustion chamber is disclosed in U.S. Pat. No. 4,041,922. The apparatus disclosed in this patent is utilized to establish a corona discharge at a single electrode gap which is exposed to the atmosphere in the combustion chamber. During an engine operating cycle, the atmospheric conditions in the combustion chamber vary in such a manner that the corona discharge can only be established during the compression stroke.

Another apparatus for electrostatically attracting fuel particles to a portion of a combustion chamber is disclosed in U.S. patent application Ser. No. 732,971 filed Oct. 15, 1976 and entitled "Ignition Method and Apparatus for Internal Combustion Engine" now U.S. Pat. No. 4,124,003. Although this application discloses several different ignition devices and methods, one of the ignition devices disclosed in the application utilizes a main spark plug and a secondary spark plug. A corona discharge is established at the secondary spark plug to effect the attraction of fuel particles to a portion of the combustion chamber adjacent to the main spark plug. The main spark plug effects initial ignition of the air-fuel mixture. Thereafter the corona discharge at the secondary spark plug changes to a continuous spark discharge to positively fire the air-fuel mixture. Still another known device utilizing a corona discharge in association with a spark plug is disclosed in U.S. Pat. No. 3,974,412.

In addition to the devices set forth above, there are many other devices for igniting a charge in a combustion chamber. One of these devices is disclosed in U.S. Pat. No. 3,842,819. This device includes a main electrode having a series gap which is wider than the associated sparking gap. The purpose of the relatively wide series gap in the main electrode is to break down and cause a rapid rise in the voltage at the spark gap. A somewhat similar ignition device is also disclosed in U.S. Pat. No. 3,842,818. It should be noted that in both of these patents the series gap in the main electrode is disposed outside of the combustion chamber and an electrostatic field at this gap would be ineffective to influence the fuel particles in the combustion chamber. In addition, spark plugs having a plurality of electrode gaps are disclosed in U.S. Pat. Nos. 2,071,254; 3,488,556; and 3,577,170.

SUMMARY OF THE PRESENT INVENTION

The present invention relates to a new and improved method and apparatus utilizing strong electrostatic fields to attract fuel particles to a portion of a combustion chamber. In order to maximize the accumulation of fuel particles, a plurality of electrostatic fields are formed at a plurality of electrode gaps disposed in the combustion chamber. In one embodiment of the invention, the atmosphere in one of the electrode gaps is maintained separate from the atmosphere in the combustion chamber. This enables the strength of an electrostatic field established at this electrode gap to be maintained substantially constant as a corona discharge is established at an electrode gap exposed to the atmosphere in the combustion chamber.

Upon initiation of an engine intake stroke with strong electrostatic fields at both of the electrode gaps, fuel particles are strongly attracted to a portion of a combustion chamber adjacent to the two electrode gaps. As the intake stroke continues, the atmospheric pressure in the combustion chamber is decreased. An initial reduction in the atmospheric pressure in the combustion chamber enables a corona discharge to begin at the electrode gap which is exposed to the atmosphere in the combustion chamber. As the combustion chamber pressure continues to decrease, the corona discharge turns into a glow discharge.

The occurrence of a corona discharge and a glow discharge at the electrode gap exposed to the atmosphere in the combustion chamber results in a reduction in the electrical potential applied across this gap and a corresponding reduction in the strength of the electrostatic field surrounding the gap. Of course, a reduction in the strength of the electrostatic field surrounding the gap exposed to the atmosphere in the combustion chamber is detrimental to the electrostatic accumulation of fuel particles in the adjacent portion of the combustion chamber.

In accordance with a feature of this embodiment of the invention, the strength of the electrostatic field at the enclosed electrode gap is maintained substantially constant during at least a major portion of the intake stroke. This is because the atmospheric pressure in the enclosed electrode gap remains constant throughout an operating cycle of the engine. Therefore, a corona discharge and/or glow discharge is not established due to a reduction in pressure at this electrode gap. This means that the electrical potential applied across the enclosed electrode gap and the strength of the electrostatic field surrounding the gap will remain substantially constant as long as the voltage applied to the electrodes is constant. Since the enclosed electrode gap is also located in the combustion chamber, the strong electrostatic field around this electrode gap promotes the electrostatic accumulation of fuel particles after the strength of the electrostatic field at the electrode gap exposed to the atmosphere in the combustion chamber has been weakened by the establishment of a corona discharge and/or glow discharge.

In another embodiment of the invention a pair of electrode gaps are exposed to the atmosphere in the combustion chamber. In order to maximize the duration of the electrostatic fields and corona discharges at these electrode gaps, a secondary electrode which is electrically insulated from a main electrode and a third electrode surface is utilized. During the intake stroke of the engine a corona discharge is established between the main electrode and the secondary electrode. Thereafter, a corona discharge is established between the secondary electrode and the third electrode surface. Establishment of two electrostatic fields and corona discharges results in an increase in the duration and extent of the electrostatic field utilized to attract fuel particles to a portion of the combustion chamber in which a lean charge is initially ignited.

Accordingly, it is an object of this invention to provide a new and improved method and apparatus which are characterized by the provision of strong electrostatic fields and/or corona discharges of long duration to enable the fuel component in a lean air-fuel mixture to be more effectively accumulated in a portion of a combustion chamber adjacent to a spark gap.

Another object of this invention is to provide a new and improved method and apparatus to accumulate fuel particles in a portion of a combustion chamber and wherein the atmosphere in an electrode gap is maintained separate from the atmosphere in the combustion chamber to enable a strong electrostatic field of relatively long duration to be established at the electrode gap.

Another object of this invention is to provide a new and improved method and apparatus to accumulate fuel particles in a portion of a combustion chamber wherein a secondary electrode is spaced apart from and electrically insulated from a main electrode surface and a tertiary electrode surface to enable a pair of electrostatic fields to be established between the secondary electrode and the electrode surfaces.

Another object of this invention is to provide a new and improved method and apparatus as set forth in the two next preceding objects and wherein corona discharges are provided in at least some of the electrostatic fields.

BRIEF DESCRIPTION OF THE DRAWINGS

The foregoing and other objects and features of the present invention will become more apparent upon a consideration of the following description taken in connection with the accompanying drawings wherein.

DESCRIPTION OF SPECIFIC PREFERRED EMBODIMENTS OF THE INVENTION

Figure 1:
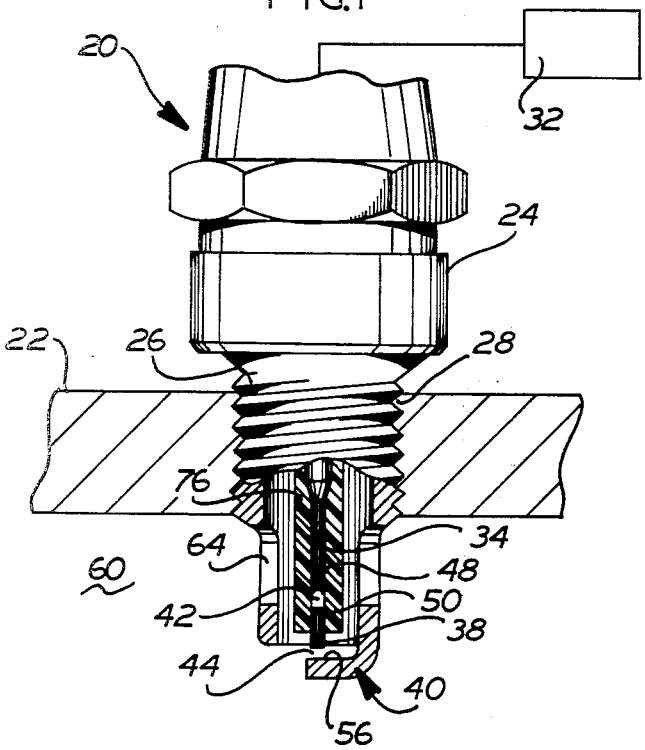
FIG. 1 is a fragmentary sectional view of an ignition plug which is utilized to accumulate fuel particles in a portion of a combustion chamber and to subsequently ignite the fuel particles.

An ignition plug 20 constructed in accordance with the present invention is shown in FIG. 1 mounted on a cylinder head 22 of a four-cycle internal combustion engine. The ignition plug 20 has a metal housing 24 with external threads 26 which engage internal threads 28 formed in the cylinder head 22 to hold the plug. A high voltage generating device 32 is connected with a generally cylindrical main or central electrode 34 of the ignition plug 20.

The high voltage generating device 32 is connected with a suitable battery (not shown) and includes an oscillating, voltage-raising transformer which is effective to raise the negative voltage of a battery. This negative polarity voltage is impressed on the central electrode 34 through a voltage rectifier. During at least the intake and compression strokes of the engine, a constant negative voltage of approximately eight thousand volts is applied to the main electrode 34 by the voltage source 32. At the end of the compression stroke, the negative voltage applied to the main electrode 34 is increased to approximately twenty-five thousand volts. Although the voltage source 32 could have many different known constructions, it is contemplated that the voltage source could advantageously be constructed in the manner disclosed in U.S. Pat. No. 4,041,922. It is also contemplated that a source of positive polarity voltage could be utilized if desired.

The ignition device 20 includes a cylindrical secondary electrode 38 (see FIG. 2) which cooperates with the main electrode 34 and a third or tertiary electrode 40 to form a pair of electrode gaps 42 and 44 which are disposed in the engine combustion chamber 60. The first electrode gap 42 is formed between a circular end face 48 of the cylindrical main electrode 34 and a circular end face 50 of the cylindrical secondary electrode 38. The second electrode gap 44 is formed between a circular outer end face 54 of the secondary electrode 38 and a generally rectangular tertiary electrode surface 56 on the tertiary electrode 40. The tertiary electrode 40 is integrally formed with a metallic housing 24 and is mechanically and electrically connected with the cylinder head 22.

In accordance with a feature of the present invention, the atmosphere in the electrode gap 42 is maintained separate from the atmosphere in the engine combustion chamber 60. This is accomplished by surrounding the electrode gap 42 with a body 76 of ceramic insulating material which electrically insulates the main and secondary electrodes 34 and 38 from the housing 24. Since the atmosphere in the electrode gap 42 is maintained separate from the atmosphere in the combustion chamber, the characteristics of the atmosphere in the electrode gap 42 remain constant during operation of the engine. Of course, the characteristics of the atmosphere in the combustion chamber 60 and the electrode gap 44 vary during the operation of the engine.

Since the pressure and composition in the atmosphere at the electrode gap 44 varies during the operation of the engine, the electrical conductivity of the atmosphere in this electrode gap also varies. However, the pressure and composition of the atmosphere in the electrode gap 42 is maintained constant during operation of the engine. Therefore, the electrical conductivity characteristics of the atmosphere in the electrode gap 42 remain constant during operation of the engine.

To promote the electrostatic attraction of fuel particles to the portion of the combustion chamber 60 adjacent to the ignition plug 20 during operation of the engine, electrostatic fields are established in the combustion chamber at the electrode gaps 42 and 44. This is accomplished by the impression of the relatively large negative polarity voltages on the central electrode 34 by the voltage generating device 32. Thus, during operation of the engine, the voltage generating device 32 is effective to constantly apply a relatively large negative voltage of approximately eight thousand volts to the main electrode 34. It should be understood that a positive polarity voltage may be utilized if desired.

The electrode gap 42 is of a relatively small size, preferably within the range of 0.2 to 0.8 mm. Therefore the secondary electrode 38 is charged across the gap 42 to the same voltage as the main electrode 34. This relatively large voltage results in a strong electrostatic field being established between the outer end surface 48 of the main electrode 34 and the inner end surface 50 of the secondary electrode 38. This electrostatic field extends into the combustion chamber 60 in the vicinity of the electrode gap 42.

A second electrostatic field is established in the combustion chamber 60 (FIG. 1) between the outer end surface 54 (FIG. 2) of the secondary electrode 38 and the tertiary or housing electrode 40. Depending upon the pressure and composition of the atmosphere in the combustion chamber 60, the electrostatic field between the secondary electrode 38 and the tertiary electrode 40 continuously fluctuates through a corona or glow discharge at the electrode gap 44. However at the end of the compression stroke, the voltage generating device 32 is effective to apply an increased negative voltage to the main electrode 34 to cause sparking to occur at the electrode gap 44.

When the pressure in the combustion chamber 60 is reduced during an initial portion of an intake stroke, the voltage potential between the secondary electrode 38 and the tertiary electrode 40 is effective to establish a corona discharge across the gap 44. This results in a reduction in the electrical potential across the gap 44 with a resulting decrease in the strength of the electrostatic field eminating from the gap 44. As the intake stroke continues, the pressure in the combustion chamber is further reduced and the corona discharge changes to a glow discharge. As this occurs, the strength of the electrostatic field is further reduced.

The pressure and composition of the atmosphere in the electrode gap 42 remains constant during operation of the engine so that a substantially constant electrical potential is established across the gap 42 during the intake stroke. This results in a relatively strong electrostatic field of substantially constant strength being formed in the combustion chamber 60 adjacent the electrode gap 42. It should be noted that the electrical potential across the electrode gap 42 is not sufficient to establish either a corona discharge or a glow discharge at this electrode gap during operation of the engine.

During the intake stroke, the strong electrostatic field extending from the electrode gap 42 is effective to negatively ionize fuel particles in a relatively lean air-fuel mixture which is being introduced into the combustion chamber 60. The resulting electrostatic forces on the air-fuel mixture results in a flow of the air fuel mixture through generally circular side openings 64 formed in the housing 24 toward the main electrode 34, that is in the direction of the arrows in FIG. 2. At this time, the fuel particles are atomized under the influence of the strong negative D.C. voltage of approximately eight thousand volts which is being applied to the main electrode 34. The negatively charged fuel particles are attracted to a generally cylindrical inner surface 68 (FIG. 2) of the housing 24 which is at ground potential. In addition, the negatively charged fuel particles accumulate on the tertiary electrode 40 which is also at ground potential.

The housing 24 has a generally circular open end 72 through which the extremely lean air-fuel mixture flows after fuel particles have been electrostatically accumulated on the inside of the housing. During the intake stroke, the atmospheric pressure in the combustion chamber 60 is reduced so that a corona discharge can be established at the electrode gap 44 between the tertiary electrode 40 and the secondary electrode 38. However, the establishment of the corona discharge at the electrode gap 42 is effective to reduce the electrostatic precipitation of fuel particles in the combustion chamber 60 adjacent to the ignition plug 20.

As the engine operating cycle continues and the compression stroke begins, the pressure in the combustion chamber 60 increases as the relatively lean air-fuel mixture in the combustion chamber is compressed. As this occurs, the conditions for establishing a corona discharge across the electrode gap 44 become less favorable. Thus, sometime after the compression stroke has been undertaken and before ignition of the air-fuel mixture in the combustion chamber 60, a corona discharge is discontinued between the circular end face 54 of the secondary electrode 38 and the surface 56 of the tertiary electrode 40. This results in the simultaneous establishment of strong electrostatic fields at the electrode gap 42 and at the electrode gap 44.

The simultaneous establishment of a pair of electrostatic fields at the electrode gaps 42 and 44 promotes the accumulation of fuel particles in the combustion chamber 60 adjacent to the ignition plug 20. This is because the first electrostatic field at the electrode gap 42 causes the air-fuel mixture to flow radially inwardly through the side openings 64 in the manner previously explained. This flow of the air-fuel mixture is directed toward the second electrode gap 44. The electrostatic field at the second electrode gap 44 further ionizes the fuel particles to promote the electrostatic accumulation of the negatively charged fuel particles on the housing 24 adjacent to the tertiary electrode 40. Thus, the effect of the two electrostatic fields at the electrode gaps 42 and 44 is additive to further enhance the electrostatic accumulation of fuel particles adjacent to the ignition plug 10.

At the end of the compression stroke, the magnitude of the negative voltage impressed on the central electrode 34 by the voltage generating device 32 is substantially increased to approximately twenty five thousand volts. This causes a spark to extend across the electrode gap 44 between the end face 54 of the secondary electrode 38 and the surface 56 of the tertiary electrode 40. This spark ignites the fuel particles which have been electrostatically accumulated around the ignition plug 20. By electrostatically accumulating fuel particles adjacent to the tertiary electrode 40, a relatively rich air-fuel mixture is provided around the ignition plug 20 even though the total charge introduced into a cylinder of the engine is very lean. This enables an air-fuel mixture which is leaner than could normally be ignited to be burned in an engine with a resulting reduction in the pollutants generated by the engine as described in U.S. Pat. No. 4,041,922 and in the aforementioned U.S. patent application Ser. No. 732,971.

In accordance with an important feature of the present invention, the effective duration of the electrostatic fields associated with the ignition plug 20 is increased in order to increase the number of fuel particles which are electrostatically accumulated adjacent to the ignition plug 20. In the embodiment of the invention illustrated in FIGS. 1 and 2 the increased duration of the electrostatic field is obtained by enclosing the electrode gap 42 with the generally cylindrical body 76 of insulating material. The insulating material 76 extends upwardly into the metallic body 24 of the ignition plug 20 and is effective to insulate the main electrode 34 from the metallic body 24 of the ignition plug. The body 76 of electrically insulating material has a cylindrical outer surface 80 of a smaller diameter than the cylindrical inner surface 68 of the metallic plug housing. This results in the formation of an annular space 82 between the cylindrical inner surface of the plug housing 24 and the body 76 of the electrically insulating material to accommodate the flow of the air-flow mixture from the side openings 64 to the open end 72 of the ignition plug housing 24.

Figure 2:
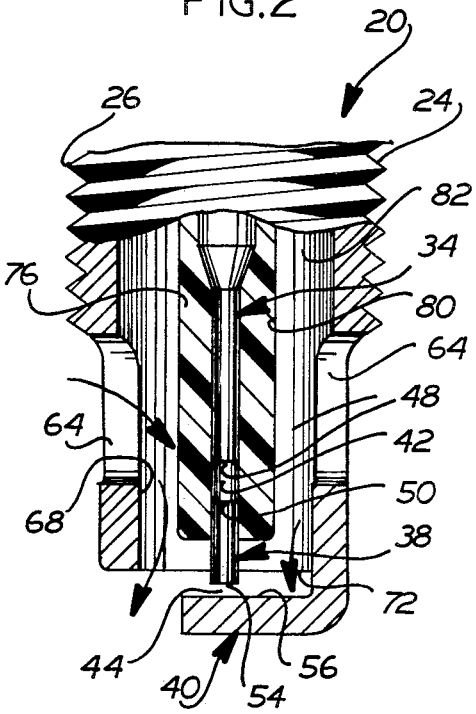
FIG. 2 is an enlarged view of a portion of FIG. 1 illustrating a pair of electrode gaps which are utilized in the establishing of electrostatic fields.

In the embodiment of the invention illustrated in FIGS. 1 and 2, the cylindrical secondary electrode 38 is held in the body 76 of insulating material by frictional forces between a cylindrical outer surface of the electrode and a cylindrical inner surface of the body 76 of insulating material. In the embodiment of the invention illustrated in FIGS. 3 and 4, mounting prongs or legs are used in association with the secondary electrode to further hold it against axial movement relative to a body of insulating material. Since the embodiments of the invention illustrated in FIGS. 3 and 4 are generally similar to the embodiment of the invention illustrated in FIGS. 1 and 2, similar numerals will be utilized to designate similar components, the suffix letter "a" being associated with the numerals of FIG. 3 and the suffix letter "b" being associated with the numerals of FIG. 4 to avoid confusion.

Figure 3:
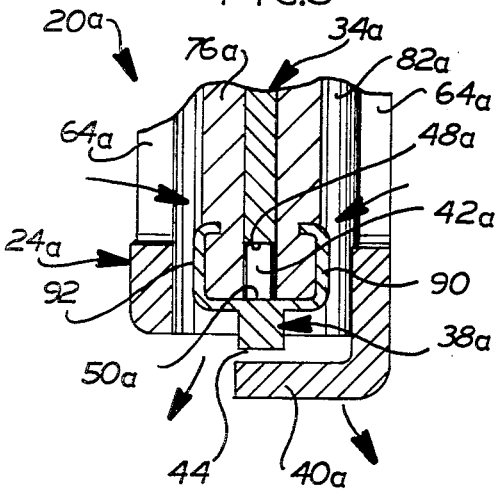
FIG. 3 is a fragmentary sectional view, generally similar to FIG. 2, of a second embodiment of the invention in which a secondary electrode is mounted on insulating material used in association with a main electrode.

In the embodiment of the invention illustrated in FIG. 3, the ignition plug **20*a* has a metallic housing 24*a* with circular openings 64*a* through which flow of a relatively lean air-fuel mixture is electrostatically induced in the manner previously explained. The ignition plug 20*a* has a main or central electrode 34*a* which is enclosed by a body 76*a* of electrically insulating material. A secondary or floating electrode 38*a* is connected with the body 76*a* of electrically insulating material by a pair of legs or prongs 90 and 92. The mounting legs 90 and 92 are embedded in the body 76*a* of electrically insulating material to accurately position an inner surface 50*a* of the secondary electrode 38*a* relative to an end surface 48*a* of the main electrode 34*a* to form an electrode gap 42*a*. The atmosphere in the electrode gap 42*a* is maintained separate from the atmosphere in the associated combustion chamber to enable a strong electrostatic field to be established across the electrode gap 42*a*** at any desired time in an operating cycle of an engine.

A second electrode gap **44*a* is formed between the secondary electrode 38*a* and a tertiary or housing electrode 40*a*. The electrode gap 44*a* is exposed to the atmosphere in the combustion chamber so that a corona discharge is established across the gap 44*a* in the manner previously explained in connection with FIGS. 1 and 2. When the charge in the combustion chamber is to be ignited, a spark is established across the gap 44*a***.

Figure 4:
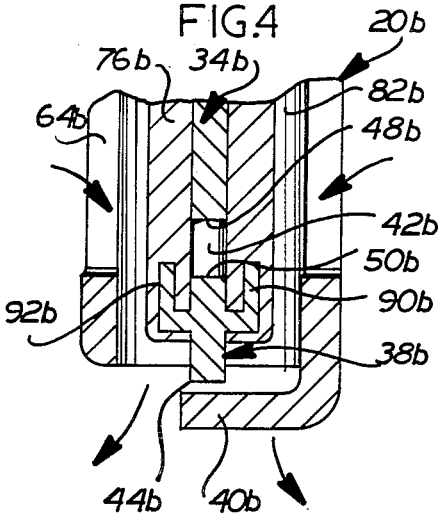
FIG. 4 is a fragmentary sectional view, generally similar to FIG. 3, of an embodiment of the invention in which portions of the secondary electrode are embedded in the body of insulating material.

In the embodiment of the invention illustrated in FIG. 4 the secondary electrode **38*b* is provided with a pair of legs 90*b* and 92*b* which are embedded in the body 76*b* of electrically insulating material. This results in the formation of a first electrode gap 42*b* between the secondary electrode 38*b* and a main electrode 34*b*. A second electrode gap 44*b* is formed between the secondary electrode 38*b* and a tertiary electrode 40*b*. The atmosphere in the electrode gap 42*b* is maintained separate from the atmosphere in the associated combustion chamber to enable a strong electrostatic field to be established across the electrode gap 42*b* while a corona discharge is established across the electrode gap 44*b***. This enables the duration of the electrostatic field to be increased to increase the electrostatic accumulation of fuel particles during each operating cycle of an engine.

In the embodiments of the invention illustrated in FIGS. 1 through 4, the duration of the electrostatic field in the combustion chamber of an engine is increased. This is accomplished by establishing an electrostatic field across an electrode gap having an atmosphere which is separate from the atmosphere of the combustion chamber while a corona discharge is being established in the combustion chamber. In the embodiment of the invention illustrated in FIG. 5 a pair of electrode gaps are both exposed to the atmosphere in the combustion chamber. In accordance with a feature of this embodiment of the invention, the duration and pattern of the electrostatic field is enhanced by an ungrounded secondary electrode which holds the applied voltage to promote the accumulation of fuel particles adjacent to the ignition plug.

Figure 5:
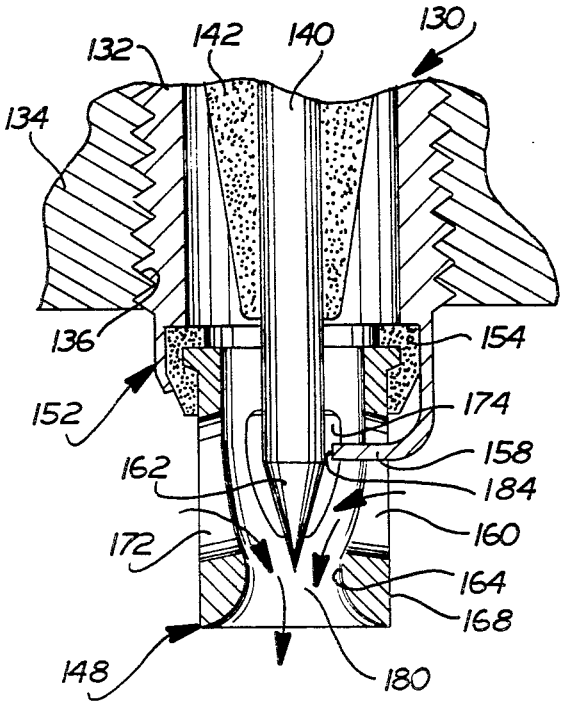
FIG. 5 (on sheet two of the drawings) is a fragmentary sectional view, generally similar to FIG. 2, of an embodiment of the invention in which a plurality of electrode gaps are formed in association with a secondary electrode which is electrically insulated from and mounted on a housing of an ignition plug.

The ignition plug 130 of FIG. 5 has a metal housing 132 which is connected with a cylinder head 134 of an engine by external thread convolution 136 formed in the housing. Although only a relatively small portion of the housing 132 has been shown in FIG. 5, it should be understood that it has the same general configuration as the housing 24 of FIG. 1.

The ignition plug 30 has a central or main electrode 140 which is connected with a voltage generating device (not shown) of the same construction of the voltage generating device 32 of FIG. 1. This voltage generating device is effective to apply a negative voltage of approximately eight thousand volts to the central electrode 140. The central electrode 140 is electrically insulated from the housing 132 and the cylinder head 134 by a body 142 of electrically insulating material. The insulating material 142 is effective to fixedly mount the central electrode 140 in the housing 132 in a well known manner.

A generally cylindrical secondary electrode 148 is mounted on an axially outer end portion 152 of the housing 132 by an annular body 154 of insulating material. The secondary electrode 148 is coaxial with the main electrode 140 and circumscribes the end portion of the main electrode. The insulating material 154 is effective to insulate the secondary electrode 148 from the housing 132. A tertiary or third electrode is formed by the housing 132. In the embodiment of the invention illustrated in FIG. 5, the tertiary of the housing electrode is provided with an inwardly projecting electrode arm 158. The electrode arm 158 extends through an opening 160 in the sidewall of the secondary electrode 148.

During operation of an engine in which the ignition plug 130 is used, a negative voltage of approximately eight thousand volts is impressed on the center electrode 140. This voltage is effective to establish an electrostatic field between a conical end portion 162 of the central electrode 140 and an inner surface 164 of the secondary electrode 148. A second electrostatic field is then established between the generally cylindrical outer surface 168 of the secondary electrode 148 and the tertiary electrode formed by the housing 132 and the inner surface of the cylinder head 134 which are at the same electrical potential. Of course as the intake stroke continues and the atmospheric pressure in the combustion chamber is decreased, a first corona discharge is established between the electrode 140 and the secondary electrode 148. Immediately thereafter, a second corona discharge is established between the secondary electrode 148 and the tertiary electrode formed by the housing 134. It should be noted that the housing 132 and cylinder head 134 cooperate to provide an annular electrode surface which circumscribes the cylindrical secondary electrode 148 and is coaxial with the secondary electrode.

The electrostatic field across the electrode gap between the secondary electrode 148 and the tertiary electrode formed by the housing 132 and cylinder head 134 ionizes the fuel particles. The resulting negatively charged fuel particles are attracted to the portion of the combustion chamber around the ignition plug 130. The effect of the electrostatic field between the secondary and tertiary electrode 148 and 134 causes the air-fuel mixture to flow radially inwardly through side openings 172, 174 and 160 formed in the secondary electrode. This flow is directed through an annular second electrode gap formed between the conical end portion 162, the main electrode 140 and the circular inner surface 164 of the secondary electrode 148. The air-fuel mixture then flows out of the secondary electrode 148 through a circular outlet opening formed by the throat of a converging-diverging nozzle surface 180.

As the air-fuel mixture passes through the annular electrode gap between the end portion 162 of the main electrode 140 and the inner surface 164 of the secondary electrode, the fuel particles are further ionized by the electrostatic field. During the operating cycle of the engine, the magnitude of the negative voltage applied to the central electrode 140 is increased to approximately twenty five thousand volts. This causes a spark to form in a gap 184 between an end surface of the arm 158 of the tertiary electrode and the side of the main electrode 140. This spark is effective to ignite the fuel particles which have been electrostatically attracted to the area around the ignition plug 130.

By having the secondary electrode 148 electrically insulated from the housing 132 and cylinder head 134, two electrostatic fields are established. The secondary electrode 148, which is not grounded, is effective to hold the applied voltage to increase the extent of the electrostatic fields. If the secondary electrode 148 was not electrically insulated from the housing 132 and cylinder head 134, it would be impossible to establish an electrostatic field between the outside of the secondary electrode and the housing 132 and cylinder head 134. By establishing two electrostatic field areas, that is on both the inside and outside of the secondary electrode 148, the extent of the pattern of the electrostatic fields is increased to increase the extent to which the fuel particles are ionized. In addition, by having the secondary electrode 148 electrically insulated from the housing 132, the duration of the electrostatic fields is increased.

Figure 6:
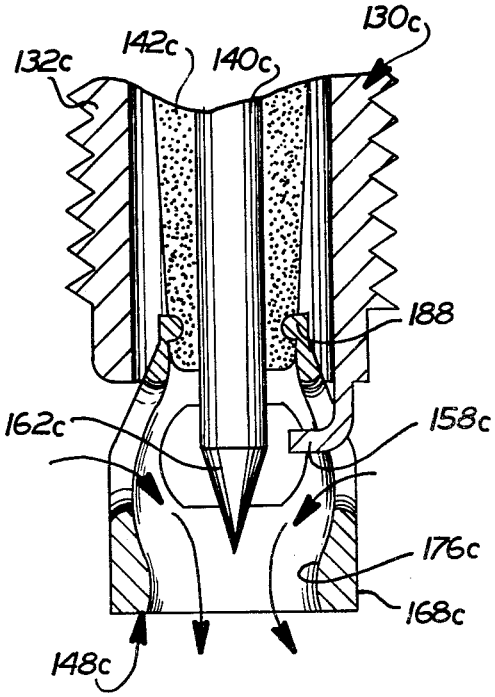
FIG. 6 is a fragmentary sectional view, generally similar to FIG. 5, of an embodiment of the invention in which the secondary electrode is mounted on a body of insulating material surrounding a main electrode.

The embodiment of the invention shown in FIG. 6 is generally similar to the embodiment of the invention shown in FIG. 5. However, in the embodiment of the invention shown in FIG. 6 the secondary electrode is mounted on a body of material which electrically insulates the main electrode from the housing. This eliminates need for additional body 154 of material to electrically insulate the secondary electrode from the housing. Since the embodiment of the invention illustrated in FIG. 6 is generally similar to the embodiment of the invention illustrated in FIG. 5, similar numerals will be utilized to designate similar components, the suffix letter "c" being associated with the embodiment shown in FIG. 6 in order to avoid confusion.

The ignition device **130*c* of FIG. 6 has a metal housing 132*c* which is connected with the cylinder head of an engine in the same manner as is the ignition device 130 of FIG. 5. The ignition device 130*c* has a central or main electrode 140*c* which is enclosed by a body 142*c* of electrically insulating material. A metal secondary electrode 148*c* is connected with the body of electrically insulating material 142*c* by an annular mounting flange 188 which is embedded in the electrically insulating material 142*c*. This results in the secondary electrode 148*c* being electrically insulated from the metal housing 132*c*, the engine cylinder head, and the main electrode 140*c***.

During operation of an engine with the ignition plug **130*c*, a relatively large negative voltage of approximately eight thousand volts is applied to the main electrode 140*c*. This results in an electrostatic field being established between a conical end portion 162*c* of the electrode 140*c* and the circular inner surface 176*c* of the secondary electrode 148*c*. In addition, an electrostatic field is established between the outer side surface 168*c* of the secondary electrode 148*c* and the housing 132*c* and an associated cylinder head. The secondary electrode 148*c* functions to extend the pattern of electrostatic field in the manner previously explained in connection with the secondary electrode 148 of FIG. 5**.

Although the embodiments of the invention shown in FIGS. 5 and 6 have housings with inwardly projecting arms 158 and **158*c* which form spark gaps adjacent to the main electrodes 140 and 140*c*, it is contemplated that the electrode arms could be eliminated if desired. This has been done in the embodiments of the invention illustrated in FIGS. 7 and 8. Since the embodiments of the invention illustrated in FIGS. 7 and 8 have many components which are similar to the components in the embodiments of the invention illustrated in FIGS. 5 and 6, similar numerals will be utilized to designate similar components, the suffix letter "d" being associated with the numerals used in association with the embodiment of FIG. 7 and the suffix letter "e" being used with the numerals associated with the embodiment of the invention illustrated in FIG. 8** to avoid confusion.

Figure 7:
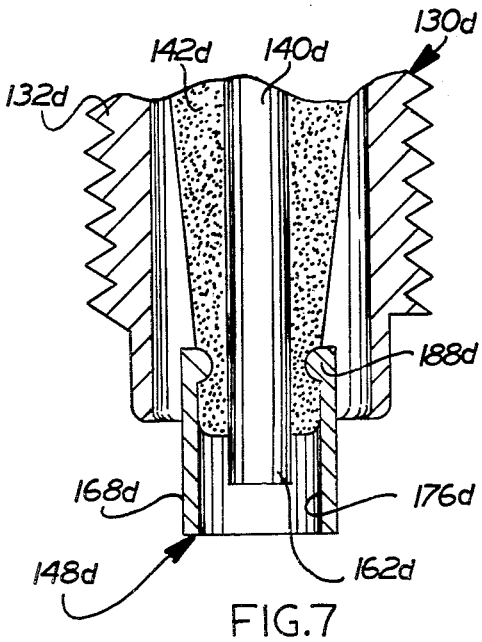
FIG. 7 (on sheet three of the drawings) is a fragmentary sectional view of another embodiment of the invention which is generally similar to the embodiment of the invention shown in FIG. 6.

The ignition device **130*d* of FIG. 7 has a metallic housing 132*d*** which is connected with the cylinder head of an engine. A relatively large negative voltage of approximately eight thousand volts is applied to a central electrode 140*d*. The central electrode 140*d* is electrically insulated from the housing 132*d* by a body 142*d* of ceramic material. A generally cylindrical metal secondary electrode 148*d* is mounted on the body of electrically insulating material 142*d* by an annular mounting section 188*d*. The cylindrical metal secondary electrode 148*d* circumscribes and is disposed in a coaxial relationship with the main electrode 140*d*.

During an operating cycle of an engine, the relatively large negative voltage applied to the main electrode 140*d* results in establishing an electrostatic field between a cylindrical outer end portion 162*d* of the main electrode and a cylindrical inner surface 176*d* of the secondary electrode 148*d*. A second electrostatic field is established across the gap between the circular outer surface of the housing 132*d* and the cylindrical outer surface 168*d* of the secondary electrode 148*d*. The electrostatic field formed between the central electrode 140*d* and the secondary electrode 148*d* and the electrostatic field between the secondary electrode 148*d* and the housing 132*d* are effective to ionize the fuel particles to electrostatically accumulate them adjacent to the ignition plug 130*d* in the manner previously explained. Of course when the pressure in the combustion chamber is reduced to a sufficient extent, corona discharges are established in the electrostatic fields.

At a predetermined time during the operating cycle of the engine, a negative voltage of approximately twenty five thousand volts is applied to the central electrode 140*d*. This results in the formation of a spark between the central electrode 140*d* and the inner surface 176*d* of the secondary electrode 148*d*. In addition, a second spark is formed between the outer surface 168*d* of the secondary electrode 148*d* and the housing 132*d*.

Figure 8:
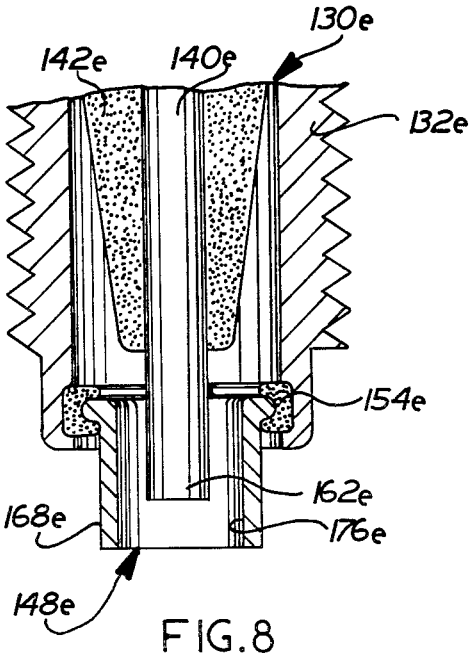
FIG. 8 is a fragmentary sectional view of another embodiment of the invention which is generally similar to the embodiment of the invention illustrated in FIG. 5.

In the embodiment of the invention illustrated in FIG. 8, a cylindrical metal secondary electrode 148*e* is mounted on the housing 132*e* of an ignition plug 130*e* by an annular body 154*e* of electrically insulating material. During operation of an engine, a negative voltage of approximately eight thousand volts is applied to a main electrode 140*e*. The main electrode 140*e* is electrically insulated from the housing 130*e* by a body 142*e* of electrically insulating material. The relatively large negative voltage results in the establishment of a strong electrostatic field between the outer end portion 162*e* of the central electrode 140*e* and the cylindrical inner surface 176*e* of the secondary electrode 148*e*. In addition, an electrostatic field is established between the cylindrical outer surface 168*e* of the secondary electrode 148*e* and the housing 132*e*.

When the fuel particles which have been electrostatically accumulated adjacent to the ignition plug 130*e* are to be ignited, a relatively large negative voltage of approximately twenty five thousand volts is applied to the central electrode 140*e*. This results in the establishment of a spark between the central electrode 140*e* and the secondary electrode 148*e* and in the establishment of a spark between the secondary electrode 148*e* and the housing 132*e*.

In the embodiment of the invention illustrated in FIGS. 1 through 8, the various ignition plugs have been described as being mounted directly on the cylinder head of an engine with the inner end portions of the ignition plugs exposed to a combustion chamber formed between the cylinder head, piston and cylinder wall of an engine. However, it is contemplated that it may be desirable to utilize these ignition devices in association with auxiliary combustion chambers similar to the ones disclosed in U.S. Pat. No. 4,041,922 and in U.S. patent application Ser. No. 732,971 filed Oct. 15, 1976. Such an arrangement is disclosed in the embodiment of the invention illustrated in FIG. 9.

Figure 9:
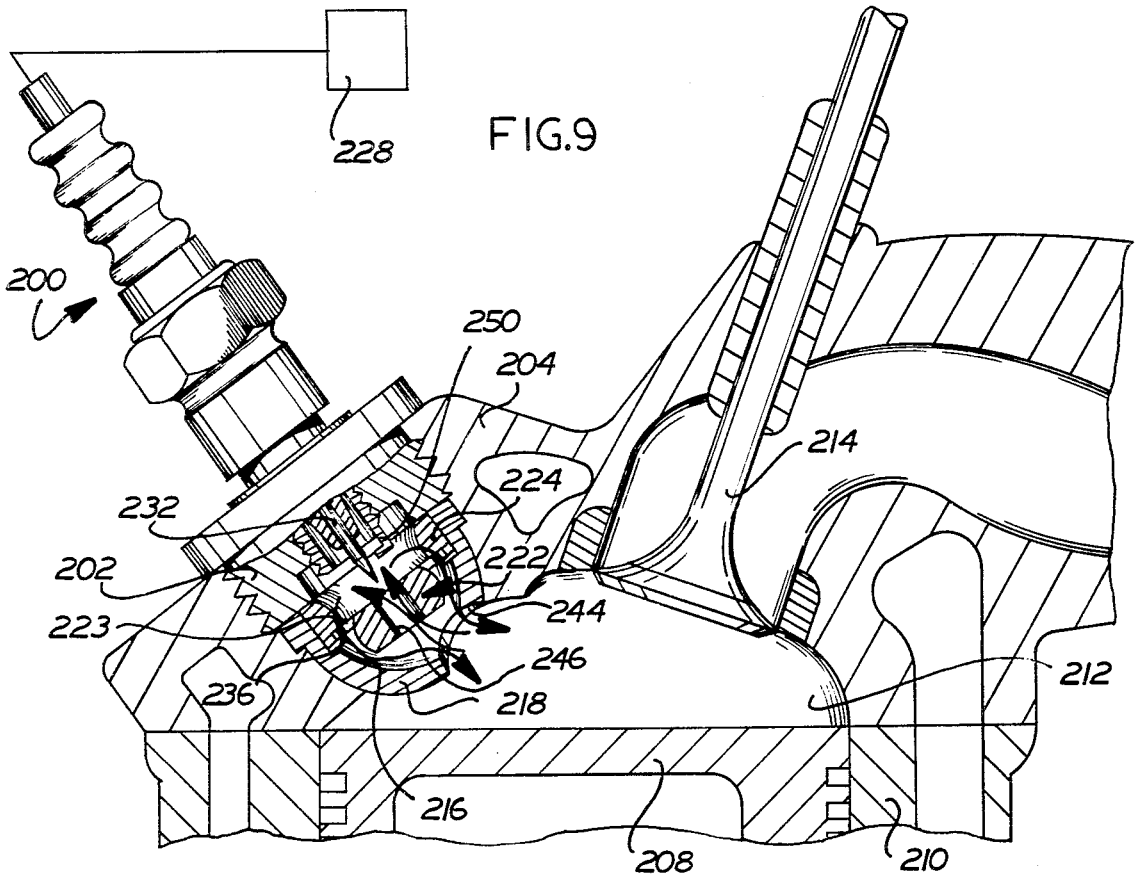
FIG. 9 (on sheet two of the drawings) is a fragmentary sectional view illustrating the manner in which an ignition plug constructed in accordance with the present invention is utilized in association with an auxiliary combustion chamber.

In the embodiment of the invention illustrated in FIG. 9, an ignition plug 200 is mounted in an adapter 202. The adapter 202 is connected with a cylinder head 204 of an engine. The engine has a piston 208 which cooperates with a cylinder wall 210 and the cylinder head 204 to form a main combustion chamber 212. A relatively lean air-fuel mixture is introduced into the combustion chamber 212 through an intake valve 214 during an intake stroke of the engine.

In accordance with a feature of this embodiment of the invention, an auxiliary combustion chamber 216 is formed by a generally hemispherical housing 218. An annular secondary electrode 222 is mounted in the housing by engagement of an annular flange 223 with an annular body 224 of electrically insulating material. The ceramic insulating material 224 electrically insulates the secondary electrode 222 from the housing 218 and cylinder head 204.

During operation of the engine, a voltage source 228 is effective to apply a relatively large negative voltage of between approximately eight thousand volts to a central electrode 232 of the ignition device 220. This results in the establishment of a strong electrostatic field between a conical end portion of the central or main electrode 232 and the secondary electrode 222. Since the secondary electrode 222 is electrically insulated from the metal housing 218, an electrostatic field will also be established between the secondary electrode 222 and the housing 218 which forms the auxiliary combustion chamber.

The electrostatic field established between the main electrode 232 and the secondary electrode 222 and the electrostatic field established between the secondary electrode 222 and the auxiliary chamber housing 218 are effective to ionize the fuel particles in a relatively lean air-fuel mixture. This results in the electrostatic accumulation of negatively charged fuel particles in the auxiliary combustion chamber 216. A plurality of openings or apertures 236 are formed in a radially extending flange 223 which connects the secondary electrode 222 with the body 224 of insulating material.

During operation of the engine, electrostatic fields between the main electrode 232 and the secondary electrode 222 and the housing chamber 218 induces a flow of lean air-fuel mixture from the combustion chamber 212 through a circular opening 244 into the auxiliary combustion chamber 216. The electrostatic field between the secondary electrode and the housing chamber 218 causes the air-fuel mixture to flow toward the central electrode 232 through a circular opening 246 in the annular secondary electrode 222. As the air-fuel mixture passes through the annular secondary electrode, it is further ionized under the influence of the electrostatic field between the main electrode 232 and the secondary electrode 222. When the pressure in the combustion chamber 212 is sufficiently reduced, corona discharges are established between the electrodes 232 and 222 and between the electrode 222 and housing 218.

The negatively charged fuel particles are deposited in the area of a sparking electrode 250. An extremely lean outward flow of an air-fuel mixture from which fuel particles have been deposited is promoted through the openings 223 in the annular flange 240. This outward flow of very lean air-fuel mixture passes through the opening 244 into the combustion chamber 212.

At a suitable time during the operating cycle of the engine, the negative voltage impressed on the main electrode 232 by the voltage source 228 is increased to approximately twenty five thousand volts. This results in formation of a spark between the electrode 250 and the main electrode 232. Since fuel particles have been electrostatically accumulated around the sparking electrode 250, the spark ignites the air-fuel mixture in the auxiliary combustion chamber 216. The resulting flame in the auxiliary combustion chamber is directed outwardly through the opening 244 into the main combustion chamber 212. This flame is effective to ignite the lean air-fuel mixture in the main combustion chamber.

Figure 10:
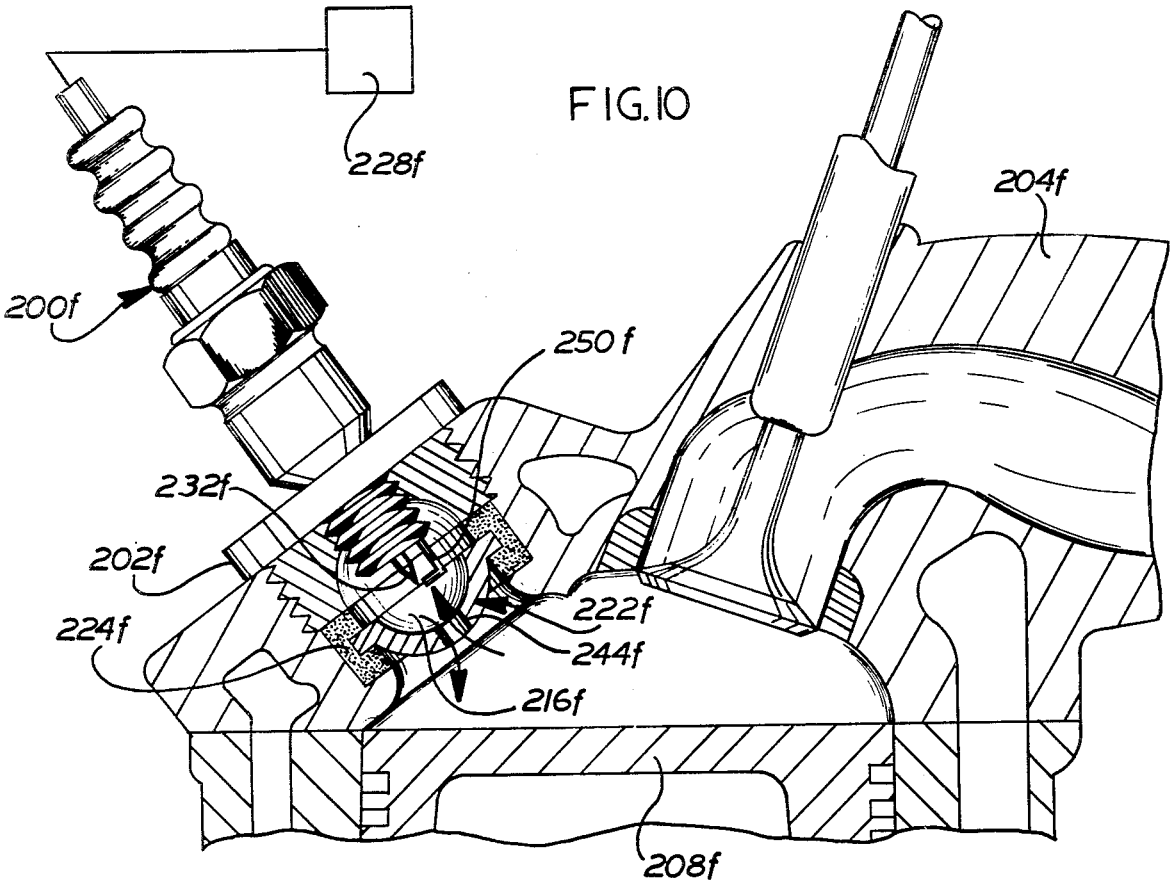
FIG. 10 (on sheet three of the drawings) is a fragmentary sectional view, generally similar to FIG. 9, illustrating an embodiment of the invention in which a portion of the auxiliary combustion chamber is defined by one of the electrodes of the ignition plug.

In the embodiment of the invention illustrated in FIG. 9, the auxiliary combustion chamber 216 is formed by the use of a separate shell or housing member 218 in the manner similar to that described in U.S. Pat. No. 4,041,922 and U.S. patent application Ser. No. 732,971 filed Oct. 15, 1976. In the embodiment of the invention illustrated in FIG. 10, the housing shell 218 is eliminated and the auxiliary combustion chamber is formed by the secondary electrode. Thus, the functions of the secondary electrode 222 and the auxiliary chamber shell 218 of the embodiment of the invention illustrated in FIG. 9 are combined into a single element in the embodiment of the invention illustrated in FIG. 10. Since the embodiment of the invention illustrated i FIG. 10 has many elements which are similar to the elements of the embodiment of the invention illustrated in FIG. 9, similar numerals will be utilized to designate similar components, the suffix letter "f" being associated with the numerals of FIG. 10 to avoid confusion.

An ignition plug 200*f* is connected with cylinder head 204*f* of an engine by a suitable mounting adapter 202*f*. The ignition plug 200*f* has a main electrode 232*f* which is connected with a voltage generating device 228*f*. An auxiliary combustion chamber 216*f* is defined by a generally hemispherical secondary electrode 222*f* which is mounted on the cylinder head 204*f* by an annular body 224*f* of electrically insulating material.

During operation of the engine, the voltage generating device 228*f* is effective to apply a relatively high negative voltage of approximately eight thousand volts to the main electrode 232*f*. This results in the establishment of a strong electrostatic field between the center electrode 232*f* and the secondary electrode 222*f*. In addition, an electrostatic field is established between the secondary electrode 222*f* and the cylinder head 204*f*.

The combined influence of these electrostatic fields results in lean air-fuel mixture being electrostatically attracted to the auxiliary combustion chamber 216*f*. As the air-fuel mixture is ionized by the electrostatic fields, the negatively charged fuel particles are deposited in the area of a sparking electrode 250*f*. An extremely lean air-fuel mixture from which fuel particles have been electrostatically deposited then leaves the auxiliary combustion chamber 216*f* through the circular opening 244*f* through which the air-fuel mixture initially entered the auxiliary combustion chamber. At the end of the compression stroke, the voltage source 228*f* is effective to impress a negative voltage of a relatively large magnitude on the main electrode 232*f* to cause a spark between the main electrode and the sparking electrode 250*f*. This spark is effective to ignite the fuel particles which were electrostatically deposited in the area of the sparking electrode.

In view of the foregoing description, it is apparent that the present invention provides a new and improved method and apparatus of using electrostatic fields and corona discharges to attract fuel particles to a portion of a combustion chamber. In order to maximize the effect of the electrostatic fields during each operating cycle, a plurality of electrostatic fields are formed across a plurality of electrode gaps. In the embodiment of the invention illustrated in FIGS. 1 through 4, the atmosphere in the electrode gap 42 is maintained separate from the atmosphere in the combustion chamber 60 to enable an electrostatic field to be established at this electrode gap after a corona discharge has been established at the electrode gap 44 which is exposed to the atmosphere in the combustion chamber 60. The relatively long duration of the extremely strong electrostatic field at the electrode gap 42 enables a relatively large number of fuel particles to be electrostatically attracted to a portion of the combustion chamber 60 in which an ignition spark is provided to thereby promote the ignition of a very lean air-fuel mixture.

In the embodiment of the invention illustrated in FIGS. 5 through 8, a pair of electrostatic fields are established at a pair of electrode gaps, one of the electrode gaps being formed between the main electrode 140 and the secondary electrode 148 and the other electrode gap being formed between the secondary electrode 148 and the housing electrode 132. In this embodiment of the invention both of the electrode gaps are exposed to the atmosphere in the combustion chamber. In order to maximize the extent of the electrostatic fields, the secondary electrode 148 is electrically insulated from the main electrode 140 and the housing or tertiary electrode surface 132. During the compression stroke of the engine, a strong electrostatic field is established between the main electrode 140 and the secondary electrode 148. Shortly thereafter a strong electrostatic field is established between the secondary electrode 148 and the housing electrode surface 132.

What is claimed is:

1. A method of accumulating fuel particles in a portion of a combustion chamber, said method comprising the steps of establishing a first electrostatic field across a first electrode gap located in said portion of the combustion chamber, maintaining the atmosphere in the first electrode gap separate from the atmosphere in the combustion chamber, electrostatically attracting fuel particles in the combustion chamber toward the first electrode gap under the influence of electrostatic forces resulting from the first electrostatic field, establishing a second electrostatic field across a second electrode gap located in said portion of the combustion chamber and exposed to the atmosphere in the combustion chamber, and electrostatically attracting fuel particles in the combustion chamber toward the second gap under the influence of electrostatic forces resulting from the first electrostatic field.

2. A method as set forth in claim 1 wherein said step of establishing a second electrostatic field includes the step of establishing a corona discharge at the second electrode gap.

3. A method as set forth in claim 2 wherein said step of establishing a corona discharge is performed after said step of establishing an electrostatic field at the first electrode gap and while the first electrostatic field is maintained at the first electrode gap.

4. A method as set forth in claim 1 further including the step of establishing a spark at the second electrode gap to ignite fuel particles in said portion of the combustion chamber.

5. A method as set forth in claim 4 wherein said step of establishing a second electrostatic field includes the step of establishing a corona discharge at the second electrode gap.

6. A method as set forth in claim 1 wherein said step of establishing a second electrostatic field includes the step of varying the second electrostatic field by changing between a corona and glow discharge at the second electrode gap.

7. A method as set forth in claim 6 wherein said step of establishing a first electrostatic field includes the step of maintaining the first electrostatic field substantially constant while performing said step of varying the second electrostatic field.

8. A method as set forth in claim 1 wherein the first and second electrode gaps are connected in series, said steps of establishing first and second electrostatic field includes the step of conducting electrical current across the first and second electrode gaps in series.

9. An apparatus for use in electrostatically accumulating fuel particles in a portion of a combustion chamber, said apparatus comprising a first electrode surface area disposed in said portion of the combustion chamber, a second electrode spaced from and electrically insulated from said first electrode surface area and disposed in said portion of the combustion chamber, said second electrode having a first surface area which cooperates with said first electrode surface area to define a first electrode gap, wall means disposed in said portion of the combustion chamber and enclosing said first electrode surface area and said first surface area of said second electrode for maintaining the atmosphere in said first electrode gap separate from the atmosphere in the combustion chamber, said second electrode having a second surface area exposed to the atmosphere in the combustion chamber, a third electrode surface area exposed to the atmosphere in the combustion chamber, said third electrode surface area cooperating with said second surface area of said second electrode to define a second electrode gap, and means for establishing a first electrostatic field in said portion of the combustion chamber by establishing an electrical potential across said first electrode gap and for establishing a second electrostatic field in said portion of the combustion chamber by establishing an electrical potential across said second electrode gap to electrostatically attract fuel particles to said portion of the combustion chamber under the influence of said first and second electrostatic fields.

10. An apparatus as set forth in claim 9 further including side wall means disposed in said portion of the combustion chamber for at least partially defining a chamber, a plurality of side openings in said side wall means through which an air-fuel mixture can flow into said chamber and an outlet opening through which an air-fuel mixture can flow from said chamber, said first electrode gap being disposed in said chamber to enable the first electrostatic field to promote a flow of an air-fuel mixture into said chamber through said side openings.

11. An apparatus as set forth in claim 10 wherein said second electrode gap is disposed closer to said outlet opening than said first electrode gap to enable said second electrostatic field to promote a flow of an air-fuel mixture from said chamber through said outlet opening.

12. An apparatus as set forth in claim 9 wherein said means for establishing a first and second electrostatic fields includes means for establishing a corona discharge across said second electrode gap after establishing an electrostatic field across said first electrode gap.

13. A method of accumulating fuel particles in a portion of a combustion chamber, said method comprising the steps of providing a main electrode having an end surface, providing a second electrode having first and second end surfaces, providing between the end surface of the main electrode and the first end surface of the second electrode a first electrode gap containing only a fluid medium, establishing a first electrostatic field extending between the end surface of the main electrode and the first end surface of the second electrode through the fluid medium in the first electrode gap, maintaining the fluid medium in the first electrode gap separate from the atmosphere in the combustion chamber, electrostatically attracting fuel particles in the combustion chamber toward the first electrode gap under the influence of electrostatic forces resulting from the first electrostatic field, providing a third electrode, providing a second electrode gap between the second end surface of the second electrode and the third electrode, said step of providing a second electrode gap including the step of exposing the second electrode gap to the atmosphere in the combustion chamber, and establishing a second electrostatic field extending between the second end surface of the second electrode and the third electrode through the combustion chamber atmosphere in the second electrode gap.

14. A method as set forth in claim 13 wherein said step of establishing a second electrostatic field includes the step of varying the second electrostatic field, said step of establishing a first electrostatic field includes the step of maintaining the first electrostatic field substantially constant while performing said step of varying the second electrostatic field.

15. A method as set forth in claim 13 wherein said step of establishing a second electrostatic field includes the step of establishing a corona discharge at the second electrode gap.

16. A method as set forth in claim 15 wherein said step of establishing a corona discharge is performed after said step of establishing an electrostatic field at the first electrode gap and while the first electrostatic field is maintained at the first electrode gap.

17. A method as set forth in claim 13 further including the step of establishing a spark at the second electrode gap to ignite fuel particles in said portion of the combustion chamber.

18. A method as set forth in claim 13 wherein said step of establishing a second electrostatic field includes the step of establishing a corona discharge at the second electrode gap.

19. A method of accumulating fuel particles in a portion of a combustion chamber, said method comprising the steps of establishing a first electrostatic field across a first electrode gap located in said portion of the combustion chamber, maintaining the atmosphere in the first electrode gap separate from the atmosphere in the combustion chamber, electrostatically attracting fuel particles in the combustion chamber toward the first electrode gap under the influence of electrostatic forces resulting from the first electrostatic field, establishing a second electrostatic field across a second electrode gap located in said portion of the combustion chamber and exposed to the atmosphere in the combustion chamber, said step of establishing a second electrostatic field includes the step of varying the second electrostatic field, said step of establishing a first electrostatic field includes the step of maintaining the first electrostatic field substantially constant while performing said step of varying the second electrostatic field, and electrostatically attracting fuel particles in the combustion chamber toward the second gap under the influence of electrostatic forces resulting from the first electrostatic field.

20. A method as set forth in claim 19 further including the step of establishing a spark at the second electrode gap to ignite fuel particles in said portion of the combustion chamber.

21. A method as set forth in claim 19 wherein said step of establishing a second electrostatic field includes the step of establishing a corona discharge at the second electrode gap.

22. An apparatus for use in electrostatically accumulating fuel particles in a portion of a combustion chamber, said apparatus comprising a first electrode having a longitudinally extending central axis, said first electrode having an end surface area disposed in said portion of the combustion chamber, a second electrode spaced from and electrically insulated from said first electrode and disposed in said portion of the combustion chamber in a coaxial relationship with said first electrode, said second electrode having a first end surface area which cooperates with said end surface area of said first electrode to define a first electrode gap, wall means disposed in said portion of the combustion chamber and enclosing said end surface area of said first electrode and said first end surface area of said second electrode for maintaining the atmosphere in said first electrode gap separate from the atmosphere in the combustion chamber, said second electrode having a second end surface area exposed to the atmosphere in the combustion chamber, a third electrode having a side surface area extending transversely to the central axis of said first electrode and exposed to the atmosphere in the combustion chamber, said surface area of said third electrode cooperating with said second end surface area of said second electrode to define a second electrode gap which is exposed to the atmosphere in the combustion chamber, and means for establishing a first electrostatic field in said portion of the combustion chamber by establishing an electrical potential across said first electrode gap and for establishing a second electrostatic field in said portion of the combustion chamber by establishing an electrical potential across said second electrode gap to electrostatically attract fuel particles to said portion of the combustion chamber under the influence of said first and second electrostatic fields.

23. An apparatus as set forth in claim 22 further including side wall means disposed in said portion of the combustion chamber for at least partially defining a chamber, a plurality of side openings in said side wall means through which an air-fuel mixture can flow into said chamber and an outlet opening through which an air-fuel mixture can flow from said chamber, said first electrode gap being disposed in said chamber between said side openings to enable the first electrostatic field to promote a flow of an air-fuel mixture into said chamber through said side openings.

24. An apparatus as set forth in claim 23 wherein said second electrode gap is disposed closer to said outlet opening than said first electrode gap and said first electrode gap is disposed closer to said side opening than said second electrode gap to enable said first and second electrostatic fields to promote a flow of an air-fuel mixture into said chamber through said side openings and out of said chamber through said outlet openings.

25. An apparatus for use in electrostatically accumulating fuel particles in a portion of a combustion chamber, said apparatus comprising a first longitudinally extending electrode disposed in said portion of the combustion chamber, a second electrode spaced from and electrically insulated from said first electrode and disposed in said portion of the combustion chamber in a coaxial relationship with said first electrode, said second electrode having a first end surface which cooperates with said first electrode to define a first electrode gap, a third electrode spaced from and electrically insulated from said first and second electrodes and disposed in said portion of said combustion chamber, said third electrode having a surface area which cooperates with a second end surface of said second electrode to define a second electrode gap, said third electrode including cylindrical wall means disposed in said portion of the combustion chamber and circumscribing said first and second electrodes, and means for establishing a first electrostatic field in said portion of the combusion chamber by establishing an electrical potential across said first electrode gap and for establishing a second electrostatic field in said portion of the combustion chamber by establishing an electrical potential across said second electrode gap to electrostatically attract fuel particles to said portion of the combustion chamber under the influence of said first and second electrostatic fields, said cylindrical wall means including surface means for defining a plurality of inlet openings through which an air-fuel mixture can flow from said portion of the combustion chamber toward said second electrode under the influence of at said first electrostatic field, said cylindrical wall means further including surface means for defining an outlet opening through which an air-fuel mixture can flow away from said second electrode into said portion of the combustion chamber under the influence of said second electrostatic field, said plurality of inlet openings being disposed closer to said first electrode gap than to said second electrode gap and said outlet opening being disposed closer to said second electrode gap than to said first electrode gap to thereby tend to promote a flow of an air-fuel mixture from said inlet openings to said outlet opening.

26. An apparatus as set forth in claim 25 wherein said means for establishing first and second electrostatic fields includes means for establishing a corona discharge across at least one of said electrode gaps after establishing an electrostatic field across said first and second electrode gaps.

27. An apparatus for use in electrostatically accumulating fuel particles in a portion of a combustion chamber during operation of an engine, said apparatus comprising a first electrode having a first electrode surface area disposed in said portion of the combustion chamber, a second electrode spaced from and electrically insulated from said first electrode surface area and disposed in said portion of the combustion chamber, said second electrode having a first surface area which cooperates with said first electrode surface area to define a first electrode gap, wall means disposed in said portion of the combustion chamber and enclosing said first electrode surface area and said first surface area of said second electrode for maintaining the atmosphere in said first electrode gap separate from the atmosphere in the combustion chamber, said second electrode having a second surface area exposed to the atmosphere in the combustion chamber, a third electrode having a third electrode surface area exposed to the atmosphere in the combustion chamber, said third electrode surface area cooperating with said second surface area of said second electrode to define a second electrode gap, and means for applying a first voltage to said first electrode during intake and compression strokes of the engine to establish an electrostatic field across said first electrode gap and an electrostatic field across second electrode gap by raising said first electrode to a potential level having an absolute value which is greater than the potential level of said second and third electrodes to electrostatically attract fuel particles to said portion of the combustion chamber under the influence of said first and second electrostatic fields and for applying to said first electrode a second voltage which has an absolute value which is greater than the absolute value of the first voltage to establish a spark across said second electrode gap near the end of the compression stroke.

28. An apparatus as set forth in claim 27 further including side wall means disposed in said portion of the combustion chamber for at least partially defining a second chamber, a plurality of side openings in said side wall means through which an air-fuel mixture can flow into said second chamber and an outlet opening through which an air-fuel mixture can flow from said chamber, said first electrode gap being disposed in said second chamber to enable the first electrostatic field to promote a flow of an air-fuel mixture into said second chamber through said side openings.

29. An apparatus as set forth in claim 28 wherein said second electrode gap is disposed closer to said outlet opening than said first electrode gap to enable said second electrostatic field to promote a flow of an air-fuel mixture from said chamber through said outlet opening.

30. A method of accumulating fuel particles in a portion of a combustion chamber of an engine, said method comprising the steps of providing a main electrode having an end surface, providing a second electrode which is disposed in the combustion chamber and has first and second end surfaces, providing between the end surface of the main electrode and the first end surface of the second electrode a first electrode gap containing only a fluid medium, maintaining the fluid medium in the first electrode gap separate from the atmosphere in the combustion chamber, providing a third electrode, providing a second electrode gap between the second end surface of the second electrode and the third electrode, said step of providing a second electrode gap including the step of exposing the second electrode gap to the atmosphere in the combustion chamber, applying a first voltage to the first electrode during intake and compression strokes of the engine to establish an electrostatic field across said first electrode gap and an electrostatic field across second electrode gap by raising said first electrode to a potential level having an absolute value which is greater than the potential level of said second and third electrodes to electrostatically attract fuel particles to said portion of the combustion chamber under the influence of said first and second electrostatic fields and for applying to said first electrode a second voltage which has an absolute value which is greater than the absolute value of the first voltage to establish a spark across said second electrode gap near the end of the compression stroke.

31. A method as set forth in claim 30 further including the step of establishing a corona discharge at the second electrode gap during the application of the first voltage to the first electrode.

32. A method of electrostatically accumulating fuel particles in a portion of a combustion chamber, the said method comprising the steps of providing a first longitudinally extending electrode disposed in the portion of the combustion chamber, providing a second electrode spaced from and electrically insulated from the first electrode and disposed in the portion of the combustion chamber in a coaxial relationship with the first electrode, the second electrode having a first end surface which cooperates with the first electrode to define a first electrode gap, providing a third electrode spaced from and electrically insulated from the first and second electrodes and disposed in the portion of the combustion chamber, the third electrode having a surface area which cooperates with a second end surface of the second electrode to define a second electrode gap, said third electrode including cylindrical wall means disposed in said portion of the combustion chamber and circumscribing said first and second electrodes, establishing a first electrostatic field in said portion of the combustion chamber by establishing an electrical potential across the first electrode gap, establishing a second electrostatic field in said portion of the combustion chamber by establishing an electrical potential across the second electrode gap, electrostatically attracting fuel particles to said portion of the combustion chamber under the influence of the first and second electrostatic fields, providing surface means for defining a plurality of inlet openings in the wall means, establishing a flow of an air-fuel mixture from said portion of the combustion chamber toward said second electrode under the influence of the first electrostatic field, providing surface means for defining an outlet opening in said cylindrical wall means, establishing a flow of an air-fuel mixture away from said second electrode into said portion of the combustion chamber under the influence of the second electrostatic field, and promoting the flow of an air-fuel mixture from the inlet openings to the outlet opening by locating said inlet openings closer to said first electrode gap than to said second electrode gap and locating the outlet opening closer to the second electrode gap than to the first electrode gap.

* * * * *

UNITED STATES PATENT AND TRADEMARK OFFICE

CERTIFICATE OF CORRECTION

PATENT NO. : 4,219,001

DATED : August 26, 1980

INVENTOR(S) : Seiichiro Kumagai et al.

It is certified that error appears in the above-identified patent and that said Letters Patent are hereby corrected as shown below:

Column 18, line 24, change "combusion" to --combustion--.

Signed and Sealed this

Third Day of February 1981

[SEAL]

Attest:

RENE D. TEGTMEYER

Attesting Officer

Acting Commissioner of Patents and Trademarks